United States Patent [19]

Skibo et al.

[11] Patent Number: 4,759,995

[45] Date of Patent: Jul. 26, 1988

[54] PROCESS FOR PRODUCTION OF METAL MATRIX COMPOSITES BY CASTING AND COMPOSITE THEREFROM

[75] Inventors: Michael D. Skibo, Leucadia; David M. Schuster, La Jolla, both of Calif.

[73] Assignee: Dural Aluminum Composites Corp., San Diego, Calif.

[21] Appl. No.: 856,336

[22] Filed: May 1, 1986

Related U.S. Application Data

[63] Continuation-in-part of PCT US84/02055 filed Dec. 12, 1984, published as WO86/02246 on Apr. 24, 1986 which is a continuation-in-part of Ser. No. 501,128, Jun. 6, 1983.

[51] Int. Cl.[4] ..... C22C 1/10

[52] U.S. Cl. ..... 428/614; 420/532; 420/534; 420/590; 148/439

[58] Field of Search ..... 420/590, 534, 537, 544, 420/546, 548; 75/0.5 R, 68 R, 93 R; 428/614; 148/415–417, 437–440

[56] References Cited

U.S. PATENT DOCUMENTS

| | | | |
|---|---|---|---|
| 2,375,211 | 5/1945 | Brennan | 175/315 |
| 2,793,949 | 5/1957 | Imich | 75/135 |
| 3,227,547 | 1/1966 | Szekely | 75/59 |
| 3,432,295 | 3/1969 | Frank | 75/206 |
| 3,468,658 | 12/1969 | Herald | 75/122 |
| 3,515,542 | 6/1970 | Larsen | 75/122.5 |
| 3,626,073 | 12/1971 | Sindelar | 13/31 |
| 3,728,108 | 4/1973 | Sifferlin | 75/135 |
| 3,753,694 | 8/1973 | Badia | 75/135 |
| 3,759,708 | 9/1973 | Sundberg | 75/208 R |
| 3,858,640 | 1/1975 | Sifferlin | 164/250 |
| 3,887,365 | 6/1975 | Sherfey | 75/214 |
| 3,888,661 | 6/1975 | Levitt | 75/201 |
| 3,889,348 | 6/1975 | Lemelson | 29/419 R |
| 3,961,945 | 6/1976 | Sanders | 75/142 |
| 4,060,412 | 11/1977 | Divecka | 75/203 |
| 4,080,200 | 3/1978 | Sheridan | 75/135 |
| 4,259,112 | 3/1981 | Dolowy | 75/208 R |
| 4,318,438 | 3/1982 | Ban | 164/97 |
| 4,383,970 | 5/1983 | Komuro | 420/520 |
| 4,435,213 | 3/1984 | Hildeman | 75/249 |
| 4,450,207 | 3/1984 | Donomoto | 428/614 |
| 4,452,865 | 6/1984 | Yamatsuta | 428/614 |
| 4,463,058 | 7/1984 | Hood | 75/229 |
| 4,473,103 | 9/1984 | Kenney | 164/97 |
| 4,481,031 | 11/1984 | Eriksson | 75/10 R |
| 4,489,138 | 12/1984 | Yamatsuta | 428/614 |
| 4,492,265 | 1/1985 | Donomoto | 164/493 |

OTHER PUBLICATIONS

S. Kaye, "Space-Related Composite-Material Experiments," J. Vac. Sci. Tech, 1974, pp. 1114–1118.

R. Mehrabian et al., "Preparation and Casting of Metal-Particulate Non-Metal Composites," Met. Trans., 1974, pp. 1899–1905.

A. Sato et al., "Aluminum Matrix Composites: Fabrication and Properties," Met Trans, 1976, pp. 443–451.

Surappa et al., "Production of Aluminium-graphite Particle Composites Using Copper-Coated Graphite Particles," Metals Tech., 1978, pp. 358–361.

S. Yajima et al., "Synthesis of Aluminum Composite Reinforced with Continuous SiC Fiber . . . " J. Materials Science, 1980, pp. 2130–2131.

R. Mehrabian et al., "Structure and Deformation Characteristics of Rheocast Metals," AMMRC TR 80-5, 1980, all pages of report.

List continued on next page.

*Primary Examiner*—Christopher W. Brody

*Attorney, Agent, or Firm*—Gregory O. Garmong; James A. Rich; Gordon P. Becker

[57] ABSTRACT

Silicon carbide particulate reinforced aluminum alloy matrix composites are formed using techniques which include agitation of a melt of aluminum alloy, containing magnesium, and silicon carbide particulates in a manner whereby the silicon carbide particles are maintained, during agitation, within the body of the melt; the agitation, which involves shearing or wiping of the particles in the liquid, is carried out under vacuum; and may involve incorporation into the melt of an additional amount of magnesium such that that amount compensates for the amount of magnesium which segregates to the carbide surfaces, and is sufficient to effect strengthening of the resulting composite. Aluminum alloy matrix composites, containing copper, are produced using similar agitation and mixing procedures, with the copper being incorporated in such a way as to discourage reaction between the copper and SiC particles.

13 Claims, 2 Drawing Sheets

OTHER PUBLICATIONS

R. Mehrabian, "A Fundamental Study of A New Fabrication Technique for Fiber Reinforced Aluminum Matrix Composites," DAAG29-76-G-0170, 1980, all pages.

B. Krishnan et al., "Performance of an Al-Si-Graphite Particle Composite Piston in a Diesel Engine," Wear, 1980, pp. 205-213.

Deonath et al., "Preparation of Cast Aluminum Alloy-Mica Particle Composites," J. Materials Sci., 1980, pp. 1241-1251.

Yajima et al., "Continuous SiC Fiber Reinforced Aluminum," from book Composite Materials, 1981, pp. 232-238.

F. M. Hosking "Compocasting of an Aluminum Alloy Composite Containing $B_4C$ Particulate," Sandia report SAND81-0976, 1981, all pages of report.

S. Yajima et al., "High-temperature Strengths of Aluminum Composite Reinforced with Continuous SiC Fiber," J. Materials Sci., 1981, pp. 3033-3038.

S. Yajima et al., "Continuous SiC Multifilament Reinforced Aluminum Composite," Revue de Chimie Minerale, 1981, pp. 412-426.

M. Surappa et al., "Preparation and Properties of Cast Aluminum-Ceramic Particle Composites," J. Materials Sci., 1981, pp. 983-993.

B. F. Quigley et al., "A Method for Fabrication of Aluminum-Alumina Composites," Met Trans A, 1982, pp. 93-100.

B. Keshavaram et al., "Cast Aluminum-glass Composites," J. Materials Sci., 1982, pp. 29-31.

A. Banerji et al., "Cast Aluminium Alloy Containing Dispersions of $TiO_2$ and $ZrO_2$ Particles," J. Materials Sci, 1982, pp. 335-342.

K. Gopakumar et al., "Metal-shell Char Particulate Composites Using Copper-Coated Particles," J. Materials Sci., 1982, pp. 1041-1048.

K. Bhansali et al., "Abrasive Wear of Aluminum-Matrix Composites," J. Metals, 1982, pp. 30-34.

A. Banerji et al., "Cast Aluminum Alloys Containing Dispersions of Zircon Particles," Met Trans B, 1983, pp. 273-281.

N. Isset Abdul-Lattef et al., "Preparation of Al-$Al_2O_3$-MgO Cast Particulate Composites Using MgO Coating Technique," J. Materials Sci., 1985, pp. 385-388.

R. Irving, "Billets and Castings Made from Si-C/Al Composites," Iron Age, 1985, p. 75.

PROCESS FOR PRODUCTION OF METAL MATRIX COMPOSITES BY CASTING AND COMPOSITE THEREFROM

BACKGROUND OF THE INVENTION

This application is a continuation in part of pending PCT application PCT/US84/02055 (which names the United States), filed Dec. 12, 1984, for which priority is claimed, which in turn is a continuation in part of abandoned U.S. patent application Ser. No. 06/501,128, filed June 6, 1983, for which priority is claimed.

This invention relates to metal matrix composite materials and, more particularly, to the preparation of such materials by a casting process.

In the past, attempts to produce metal alloy-particulate material composites by the addition of particulate material to the molten alloy, followed by casting the resulting composite, have not been particularly successful. It has been postulated that the major difficulty with such an approach is that the particulates, such as silicon carbide, are not wetted by molten alloys and that, because of this, the introduction and retention of the particles in the liquid matrix is extremely difficult, if not impossible. Mehrabian et al., *Metallurgical Transactions,* vol. 5, August 1974, pages 1899–1903.

It has also been suggested that such wettability could be achieved by coating the particles with nickel. F. A. Badia, *Trans. A.F.S.,* 1971, vol. 79, page 347; F. A. Badia et al., *Trans. A.F.S.,* 1971, vol. 79, page 65; and Badia et al., *Trans. A.F.S.,* 1969, vol. 77, pages 402–406. Another technique has involved promoting wetting of the refractory particles in the melt by saturating the melt with anions of the refractory particles, U.S. Pat. No. 3,468,658. Another method, described in U.S. Pat. No. 2,793,949 comprises the addition of such elements as lithium, magnesium, silicon, calcium, and so forth, into the melt prior to the addition of the refractory particles. Still another method, described in the aforesaid article by Mehrabian et al. involves the addition of particles of silicon carbide to a vigorously agitated, partially solidified slurry of the alloy.

Still another attempt to improve the wettability of the particulates has involved subjecting large particulate materials and fibers in the melt to ion bombardment, mechanical agitation, vacuum, and heat, in order to remove moisture, oxygen, adsorbed gases, and surface film therefrom. Such a procedure is described in the article by S. Kaye, "Space Related Composite Material Experiments", *Journal of Vacuum Science Technology,* vol. 11, no. 6, November/December 1974.

The fabrication of aluminum alloy-alumina fiber composites is described in the article by Quigley et al., *Metallurgical Transactions A.,* vol. 13A, January 1982–93. The procedure involves use of a stirrer blade with a paddle type design, the blade being designed to move very close to the walls of the crucible to induce a high shear and create a vortex for introduction of the fibers into the melt. The process also requires a baffle, which is immersed slightly below the surface of the melt with a tilt angle of about 45° in the direction of flow, the function of the baffle being to divert the flow pattern in the melt and to aid in the entrapment of the fibers below the surface of the melt. Such an impeller, due to its design, does not result in substantial shearing or wiping action of the melt and particulates.

Surappa et al., *Journal of Materials Science,* 16 (1981), 983–993, describes a casting technique for preparing, inter alia aluminum-silicon carbide particle composites, using the vortex method of dispersion of particles. The particles are pre-heated for 60 minutes at 900° C. prior to addition to the melt to aid in their introduction into the melt. The vortex was created by stirring the melt using a mechanical impeller of some kind. No shearing or wiping is utilized and only very low volume fractions of the particulate could be added to the melt.

For various reasons, none of the foregoing methods have been found to be commercially acceptable and, to the best of applicants' knowledge, silicon carbide aluminum alloy metal matrix composites which are commercially available are made, not by any of the foregoing processes, but by two essentially different processes, hereinafter described, which are generally similar to each other.

In both of these commercial processes, carefully sized aluminum powder is mixed with silicon carbide whiskers, or particulate, in the presence of an organic solvent. A solvent is necessary to prevent a pyrophoric reaction between the aluminum and the oxygen in the air. The mixture is poured into drying trays, and the solvent allowed to evaporate over a period of time. The dry, unconsolidated sheets, at this point, which are approximately 40 mils. thick, are stacked to form a plate of the desired thickness. This fragile stack of sheets is placed in a press and heated to the liquid-solid regime of the matrix, where the metal is slushy in character. The stack is then pressed, consolidating the particles, and forming a solid plate.

In the other commercial process, the silicon carbide particles and aluminum are mixed, as above, but the mixed powder is poured into a cylindrical mold, and consolidated by vacuum hot pressing into a cylindrical billet. Because of the high costs of raw materials, particularly aluminum powders, and the complexities of the fabrication process the current costs of the composites discourage their large-scale use in many areas.

Both of the commercial processes above described result in composites which, while having high modulii and adequate strength, have a ductility and formability which are low. The complex super-heating and deformation cycle which is required in the above processes, produce extensive elemental segregation in the matrix, which decreases ductility and prevents the attainment of maximum matrix, and composite, strength. A further problem is the retention of the surface oxide which coated the original aluminum powder particles, this serving to further decrease matrix ductility. It would also appear that the oxide coating prevents the complete wetting of the carbide particles, thus further limiting the ultimate composite properties.

SUMMARY OF THE INVENTION

In accordance with the present process, silicon carbide-aluminum alloy composites are fabricated by mixing silicon carbide particulates, such as grinding abrasive, or other forms of fibrous or particulate silicon carbide into molten aluminum alloys under predetermined conditions of mixing, temperature, mixing times, and pressures, together with the addition of magnesium and/or copper, as needed, followed by casting.

In the present process, silicon carbide in particulate form, e.g., grinding abrasive, is mixed, under argon or in vacuum, into molten aluminum alloys which have been degassed and fluxed in order to remove hydrogen gas, oxide particles, and the like. A wide range of standard wrought, or other aluminum alloys, may be used as for example 6061, 2024, 7075, 7079, to mention a few.

In order to attain ultimate composite properties, we have found that the composition of each alloy should be modified. Thus, in all of the above alloys, magnesium is a common alloying element, which imparts hardness and strength. When adding silicon carbide to the melt, a portion of the magnesium component of the alloy, segregates to the carbide surfaces, thus depleting the matrix of this important strengthening element, and preventing the matrix from coming to full strength. By compensating for this phenomenon, that is by adjusting the composition of magnesium in the initial melt to a higher level, the resulting composite can be strengthened significantly. We believe that the depletion of magnesium from the matrix is a function of the carbide particle surface area, and that, therefore, the amount of additional magnesium required to compensate for such depletion be related to the amount and size of carbide particles. We have found that an addition of about 0.05 weight percent, w/o, of magnesium was effective to do this, for each 1 volume percent, v/o, of 22 micron (600 mesh) silicon carbide added to the aluminum alloy. This amount is based on the assumption that the particles are cylindrical and are 22 microns in diameter, 5 microns high, and have a magnesium surface layer about 100 Angstroms thick. Suitable analytical techniques can be used to determine the amount of magnesium in the composite, as those skilled in the art will understand.

We have also found that impellers such as have been used in the past to mix reinforcement particles and molten aluminum are unsatisfactory and will not effect the intimate contact between the particulate material and the molten aluminum which is necessary if homogeneity, and particle wetting is to be obtained. Thus while impellers which cause formation of a vortex, in operation, draw the particulate material down into the body of the melt, this is transitory, since nearly all of the particles rise to the top of the melt as soon as the impeller stops rotating.

The use of a specially designed impeller having angled blades, illustrated in FIG. 1 of the drawings, provides a shearing and wiping action which effectively homogenizes the mixture of molten aluminum and particulate material. The blades of our impeller can be angled from about 15° to 45°, and are at a pitch such that particulate material is brought down from the surface of the melt and remains below the surface while the shearing and wiping action, which results in wetting of the particulates, continues during the mixing.

Following the mixing step, the resulting mix is cast, preferably by pressure casting as will be further described hereinafter.

In carrying out our process, the silicon carbide powder is added to the surface of molten aluminum alloy and mixed into the melt with an impeller, as described above, which agitates the surface of the melt, and by its shearing and wiping action, quickly wets silicon carbide particles while at the same time dispersing the particles through the melt.

The amount of silicon carbide added to the melt may vary substantially, with the upper amount being essentially a function of the ability to stir the melt plus silicon carbide particles so as to achieve substantial homogeneity, as the greater the amount of the silicon carbide of a particular size and shape, the higher the viscosity of the resulting melt. Similarly, the size and shape of the silicon carbide particles may vary with similar consideration. Selection of the size, shape, and amount of the silicon carbide particles for a particular melt are within the skills of the artisan. Above 725° C., wetting proceeds rapidly but unless measures are taken, the oxidation rate also rises. If the mixing temperature is too high, much oxide will be mixed into the melt, without suitable precautions and techniques, discussed hereinafter in detail, being used.

For adequate wetting of the carbide particles, a mixing time of about 35–50 minutes after the silicon carbide is added, is desirable. Shorter durations result in poor silicon carbide distribution and composite mechanical properties.

To further improve the wetting of the silicon carbide particles, they are mixed with molten aluminum alloy under a vacuum, this serving to remove dissolved gas from the melt, which would normally slow the wetting process. The degassing of the metal also reduces porosity in the final casting.

The mixed liquid composite is finally cast into a mold, either by conventional gravity casting, or by pressure casting. We have found that pressure casting reduces porosity in the solidified billet, which further improves the properties of the composite, and facilitates later forming processes. Pressure casting is particularly useful when casting composites containing a high percentage of silicon carbide and the resulting high melt viscosity makes difficult, or prevents, the use of conventional casting.

The resulting billet should be annealed and subsequently hot worked in order to insure adequate homogeneity of the alloy constituents within the matrix. The composite can then be hot formed using conventional metal forming procedures to achieve desired shapes and properties. The alloy is then heat treated to achieve maximum mechanical properties, care being taken during the heat treatment to account for the reduced thermal conductivity of the composite resulting from the inclusion of the silicon carbide therein.

It will be understood that the simultaneous optimization and control of process parameters is required to produce high quality silicon carbide reinforced aluminum by casting and subsequent hot working, these parameters include:

1. Reinforcement Selection: The size and shape of the silicon carbide particulate or fiber utilized are important variables since they control the viscosity of the melt and define, through their surface-to-volume ratios, any required alloy composition modifications.

2. Melt Stirring: In order to efficiently allow the silicon carbide to be introduced into the aluminum melt and to be thoroughly mixed, a particular stirring action is achieved through the use of an impeller which maximizes the type of agitation wherein the particles of silicon carbide are wiped and wet by the melt and prevented from staying on the surface or returning to the surface of the melt.

3. Temperature: The optimum process temperature is in the range of about 680° C. to about 725° C.

4. Time: While stirring is preferably in the 35–50 minute range this can be changed with an accompanying change in the temperature.

5. Vacuum Mixing: Properties are optimized through vacuum degassing of the melt. Because added quantities of gas are normally introduced with a silicon carbide particulate, which has a high surface area, melt degassing is even more important to composite processing than it is in standard aluminum melting practice.

6. Aluminum Alloy Selection: It is important that the aluminum alloys be carefully selected so that various alloying elements do not deleteriously interact with the silicon carbide. Furthermore, use of wrought aluminum alloys allow post-casting homogenization through metal deformation with its attendant property maximization.

7. Aluminum Alloy Modification: Standard aluminum alloy compositions are modified to increase their wettability to silicon carbide, as by the addition of magnesium to maintain the strength-imparting effect of magnesium.

8. Alloy Heat Treatment: Because of the reduced thermal conductivity of the composite, the heat treatments used should be modified to allow for this.

The invention is more fully explained by reference to the drawings taken together with the description hereinbefore and hereinafter, wherein.

Figure 1:
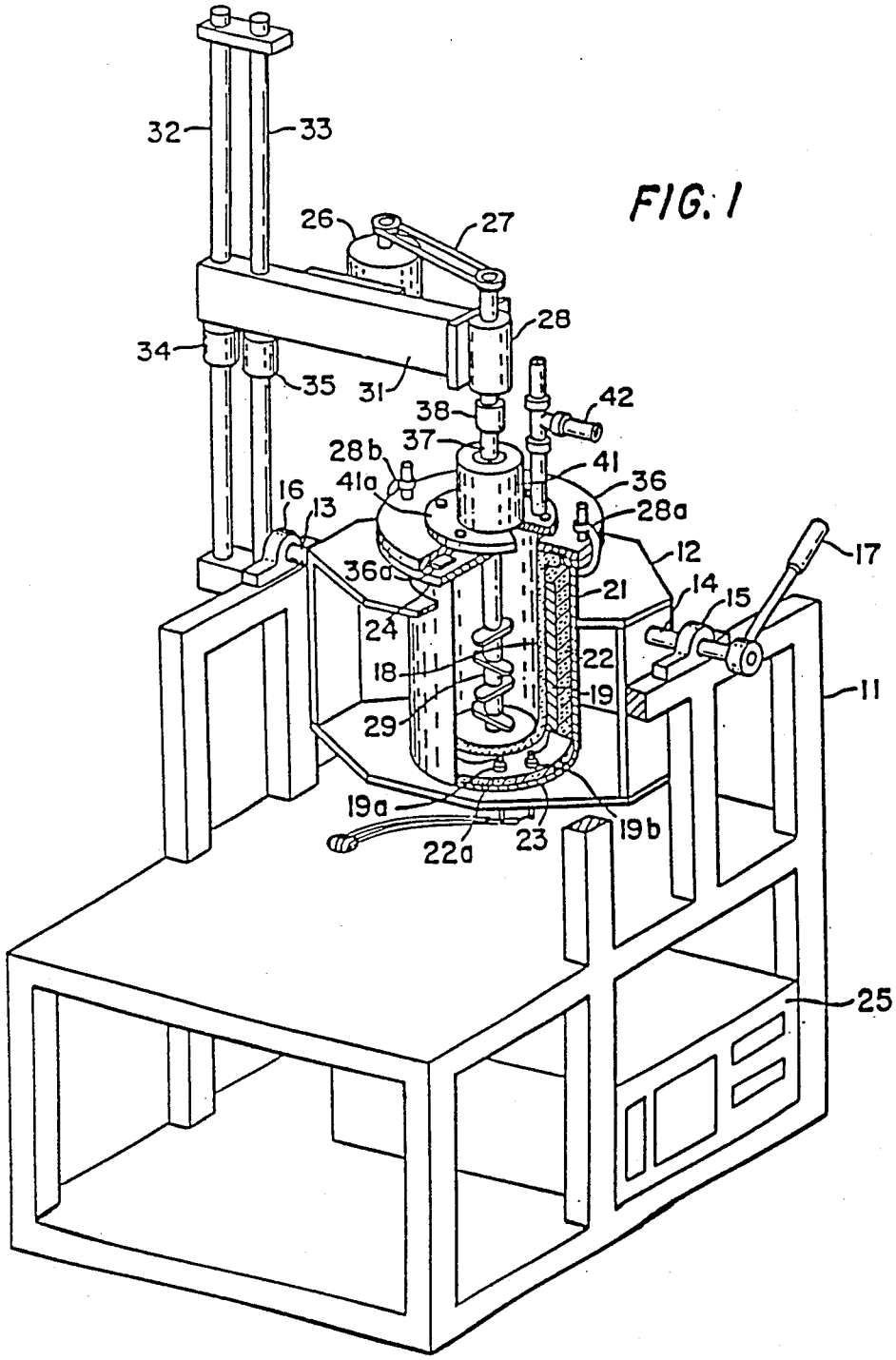
FIG. 1 is an exploded view in perspective, and partly broken away, of apparatus for carrying out the metal-melting, particulate-addition, and mixing steps of the invention, showing the mixing head in place.

Referring to FIG. 1, the apparatus comprises a metal stand 11, upon which is supported a rotatable furnace holder 12. The furnace holder 12 is equiped with shafts 13 and 14 secured thereto, as shown, by welding or the like, journaled to pillow blocks 15 and 16. Handle 17 secured to shaft 16 is used to rotate the holder 12 as desired.

Crucible 18, formed of alumina has an inside diameter of 3¾ inches, is 11 inches high, is resistively heated by a Thermcraft No. RH274 heater 19, and is insulated with Watlow blanket insulation 22 and low density refractory shown at 22*a*. This insulated assembly is positioned inside a 304 stainless steel pipe which has a ¼ inch thick solid base 23 and a top flange 24 welded thereto, to form container 21. Container 21 serves not only as a receptacle for crucible 18, but also functions as a vacuum chamber during mixing. The power for heater 19 is brought through two Varian medium power vacuum feedthroughs (19*a* and 19*b*) and two type K thermocouples positioned between crucible 18 and heater 19 used for temperature control and monitoring, are brought to container 21 using Omega Swagelock-type gas-tight fittings (not shown).

The temperature of crucible 18 is controlled with an Omega 40 proportional controller 25 which monitors the temperature between the crucible and the heater. Controller 25 drives a 60 amp Watlow mercury relay, which switches 215 volts to heater 19, the temperature being monitored with a Watlow digital thermometer.

The mixing assembly consists of a ¼ horsepower Bodine DC variable speed motor 26 controlled by a Minarik reversible solid state controller (not shown). The motor 26 which is secured to arm 31 is connected by cog belt 27 to a ball bearing spindle 28 which is supported over the crucible 18 and holds the spinning impeller 29.

Spindle 28 is secured to arm 31 which is slidingly connected to supports 32 and 33 to permit vertical movement of the arm 31. Clamps 34 and 35 can be locked to secure arm 31 in the position desired.

Impeller 29 is machined from 304 SS and TIG-welded together, bead blasted, then coated with Aremco 552 ceramic adhesive. The coated impeller 29 is kept at 200° C. until needed.

A removable metal flange 36 covers the container 21, as shown, with a gasket 36*a* between the upper flange of the container 21 and flange 36, and can be sealed in an airtight manner by clamps (28*a* and 28*b*). A shaft 37 is releasably secured to spindle 28 by means of chuck 38 and passes through vacuum rotary feed-through 41, equipped with flange 41*a*.

A port 42 equipped with a tee-fitting in flange 41*a* permits ingress and egrees of argon from a source (not shown), and is adapted for application to a vacuum line to permit evacuation of crucible 18.

Figure 2:
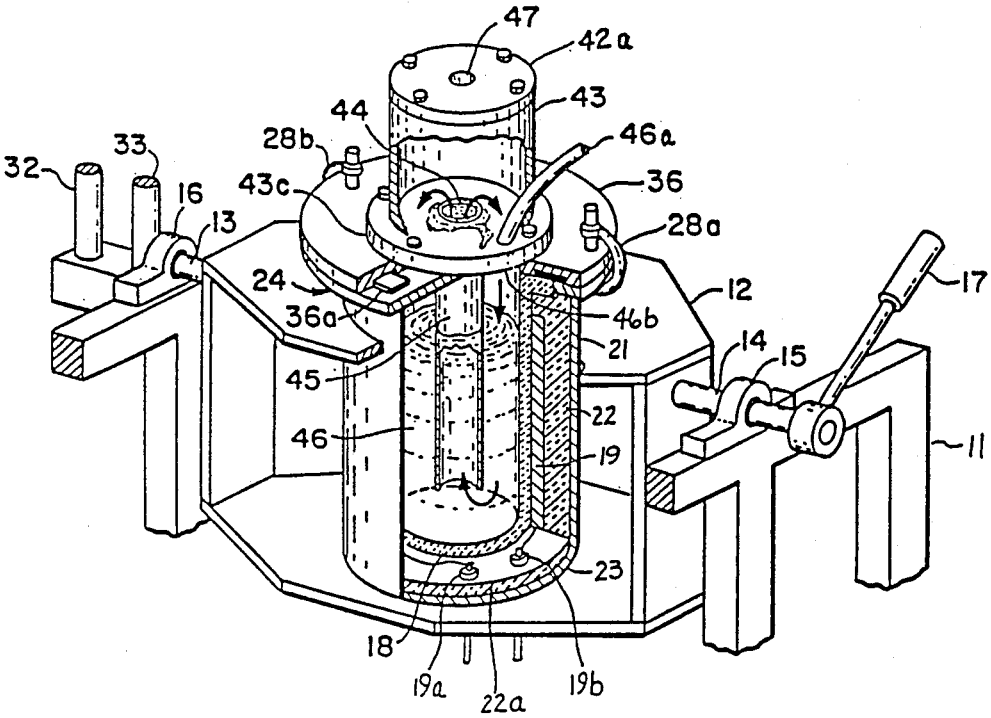
FIG. 2 is an exploded view in persepective, and partly broken away of a pressure casting head as it would appear when it replaces the mixing head shown in FIG. 1.

Referring to FIG. 2, the pressure casting assembly includes a stainless steel cylindrical mold 43. This mold is comprised of a top 42*a*, a flanged bottom 43*c*, and a tubular mid-section, bolted together as shown. The flanged bottom 43*c* of mold 43 has a machined port 44 through which a heavily oxidized 304ss tube 45 is pressed and locked in place with a set screw (not shown). Tube 45 is immersed in the liquid composite 46, the end of tube 45 being positioned within ½" from the bottom of crucible 18.

The bottom 43*c* of mold 43 is bolted to top flange 36 which is clamped by means of clamps 28*a* and 28*b* to container flange 24. A silicone gasket 36*a* provides a pressure seal.

Port 46*b* in the flanged bottom 43*c* of the mold 43 serves as an inlet for low pressure air entering through tube 46*a*, which pressurizes the chamber causing the molten aluminum composite to rise up tube 45 filling mold 43. Opening 47 in mold top 42*a* vents air during the pressure casting process.

In carrying out the process of the present invention, the heater is activated and the controller set so that the temperature is above the melting point of the aluminum alloy. The aluminum alloy is then placed in the crucible and when the alloy has melted, any other alloying elements which are to be incorporated into the melt are added. The temperature is thereupon reduced somewhat and the melt is blown with argon by bubbling the gas through the melt. Silicon carbide particulate is then added to the melt, the mixing assembly above described put in place, a vacuum pulled, and mixing begun. Periodically the chamber is opened to permit cleaning of the crucible walls while maintaining an argon cover over the surface of the melt.

After sufficient mixing has occurred, the mixing assembly is removed, and is replaced by a pressure casting head and mold.

The composite is then forced into the mold, by air pressure; when the composite is cooled it is removed from the mold.

The following illustrative examples are presented in order to more completely illustrate preferred embodiments of the invention and to enable those skilled in the art to practice the present invention. It should be understood however that such examples are merely illustrative and are not to be construed in any restrictive sense, and changes and modifications may be made therein without departing from the spirit and scope of the invention as defined in the appended claims.

EXAMPLE I

Fabrication of 6061-Silicon Carbide Composite

Before mixing the following steps are taken:

The impeller 29 which has been previously bead-blasted clean is given three coatings of Aremco 552 adhesive ceramic coating and after the last coating is cured, is kept at 200° C. prior to mixing, in order to keep it dry. The silicon carbide powder (600 mesh) is also maintained at 200° C. to drive off any adsorbed water. The metal to be used in the heat, is cut into convenient size and weight. In this example, the metal consists of 6061, A520 (10% Mg-Al) and A356 (7% Si-Al). The pressure-casting mold is assembled and warmed with heat tape to 300° C.

The mixing furnace is started and the temperature set at 850°-870° C. The crucible 18 is quickly warmed.

1790 grams of 6061 bar stock are now charged to the crucible 18 and the argon cover gas is turned on for entry through port 42. The A520 is held back due to its extremely low melting point and susceptability to oxidation. As the 6061 begins to melt, the temperature is reduced to 680° C. (680°-720° C. is a workable range). 245 grams of A520 and 23 grams of A356 are then added to the molten 6061.

Argon is blown into the melt at the rate of 100 cc/min, for 15 minutes, displacing any adsorbed hydrogen, and bringing oxide particles to the surface, which are skimmed off. 655 grams of 600 grit silicon carbide are then added to the melt, the mixing assembly put in place, and a vacuum pulled on crucible 18 through port 42, to 15-20 torr or lower.

The mixer motor 26 is then turned on and the impeller 29 set to rotate at approximately 750 rpm. After 5 minutes of mixing the chamber is brought to atmospheric pressure with argon, the vacuum feedthrough is lifted slightly, and any excess silicon carbide powder coating the walls is scraped back into the melt. The chamber is then resealed and evacuated. This cleaning is repeated two more times at 5 minute intervals. The melt is stirred for a total mixing time of 50 minutes, and the motor then stopped.

The pressure casting head of FIG. 2 with the heated mold and fill-tube 45 is now clamped into place, and the fill-tube 45 immersed in the molten aluminum composite 46 to nearly the bottom of the crucible. The inside of the chamber is then slowly pressurized to 1.5 psi through an external valve, a small compresser supplying the pressure. This low pressure forces the composite up the fill-tube into the mold.

When the aluminum seeps out of the small vent hold 47 and seals it, the pressure is raised to 9 psi until the metal within the mold is completely solidified.

After the metal cools it is removed from the mold.

The process for the fabrication of a 6061 aluminum alloy-silicon carbide composite defined in Example I may be further simplified, to no apparent detriment of the composite material, by eliminating the vacuum-pressure cycles encountered during the opening and closing of the mixing chamber for the purpose of cleaning the walls of the crucible. This is accomplished by performing the first part of the mixing and cleaning under an Argon cover at atmospheric pressure followed by the completion of mixing under a vacuum of 10-20 torr which removes most dissolved gases and insures effective wetting of the SiC particulate.

The following example illustrates the preparation of a 6061-600 mesh silicon carbide composite using a thus-modified procedure.

EXAMPLE II

Modified procedure for fabrication of a 6061-Silicon Carbide Composite

As in Example I, the impeller after bead-blasting clean is given three coats of Aremco 552 adhesive ceramic coating and maintained at 200° C. prior to mixing. The silicon carbide is also kept dry at 200° C.

1795 grams of 6061 bar stock, 250 grams of A520, and 23 grams of A356 are weighed out and cut into convenient sized pieces for charging into crucible 18.

The mixing furnace is started and controller temperature set at 850°-870° C.

The 6061 bar stock is charged into crucible 18 and the argon cover gas is turned on. As the 6061 begins to melt, the crucible temperature is reduced to 680° C. The A520 and A356 are then added to the molten 6061.

As in Example I, argon is blown into the melt for 15 minutes to displace any adsorbed hydrogen and to lift suspended oxide particles to the surface. 655 grams of 600 mesh silicon carbide are then added to the melt, the mixing assembly put into place and an argon flow maintained over the melt through port 42.

The mixer motor 26 is turned on and impeller 29 set to rotate at approximately 750 rpm. After 5 minutes of mixing, the motor is stopped, the silicon carbide powder coating the walls is scraped into the melt and the motor restarted. This cleaning is repeated two more times. After 40 minutes of mixing under argon at atmospheric pressure, the mixing chamber is slowly evacuated to 10-20 torr while the melt is being continually stirred. After a total mixing time of 50 minutes, the motor is stopped.

As in Example I, the pressure casting head shown in FIG. 2 is now clamped into place, and the outside of the mixing chamber pressurized through port 46 using a small compressor. This low pressure forces the composite up the fill tube 45 and fills the mold 43. When aluminum seeps out of the vent hole 47 and solidifies, sealing the hole, the pressure is raised to 9 psi until solidification is complete. After cooling, the metal is removed from the mold.

By controlled mixing of the silicon carbide powder into liquid 6061 as set out in the above Examples I and II, it is possible to fabricate a composite material which demonstrates near-theoretical rule-of-mixture modulus with good strength and ductility.

Similar attempts to use 2024 as a composite matrix resulted in stiffened or high modulus composites with modest strength but very low ductility. This was unexpected since in the common heat treated condition (T4) 2024 is much stronger, tougher, and exhibits higher elongation than 6061-T6. This low ductility persists even in the fully annealed condition when the matrix should be at its softest.

The hardness of pressure cast silicon carbide-2024 composites is always high (much higher than the silicon carbide-6061 composites) and could not be softened further regardless of the duration of annealing. After heat treating the composites to achieve full matrix strength, the composite was harder. The difference between the annealed and fully strengthened condition was not characteristic of standard 2024 behavior, which shows an immense change in hardness upon aging. This composite material was so hard to machine that a carbide tool bit was destroyed almost immediately upon contact—also a characteristic of certain powder-fabricated composites. It appears then, that some detrimental reaction occurs between the silicon carbide and some constituent in the 2024. The major differences between 6061 and 2024 is that the latter contains 4.5 weight percent copper and 0.6 weight percent manganese. It is known that manganese, copper, iron as well as most of the bivalent transition metals can react with silicon carbide at temperatures as low as 700° C. to form intermetallic silicides, leaving a graphite residue. Conceivably the rapid shearing action of our mixing process could bring the metal into intimate contact with the silicon carbide causing an immediate reaction to occur. Since these compounds are stable at the temperatures of mixing, they could be dispersed into the melt and should not dissolve. These compounds may be responsible for the aforesaid high viscosity.

To eliminate or minimize such copper-silicon carbide reaction, a somewhat different mixing technique was developed for the 2024 alloy. Initially, an alloy containing only magnesium and aluminum is melted (essentially 2024 without the copper) and the silicon carbide is mixed into this melt under vacuum. The appropriate amount of copper is then added in the form of fine shot and the melt is mixed for an additional 5 minutes.

It was found that the viscosity of the final melt was reduced, which facilitated pressure casting of the billet, and resulted in a casting which was soft and could be easily machined. The billets were forged into a disc, and a study of the hardness of these pressings demonstrated near classical 2024 response. The material could be made soft and hardness increased significantly with aging time as predicted. The strips which were cut from these plates showed much increased ductility.

The following example more fully illustrates the preparation of a 2024–600 mesh silicon carbide composite.

EXAMPLE III

Fabrication of 2024-Silicon Carbide Composite

As in the case of Example I, the impeller, after bead blasting clean, is given three coats of Aremco 552 adhesive ceramic coating and the coated impeller kept at 200° C. prior to mixing. The silicon carbide powder is also maintained at 200° C. to drive off adsorbed water.

1710 grams of pure aluminum and 400 grams of A520 are cut and weighed. 97 grams of copper is also weighed, but kept separate. The mixing furnace is started and the temperature set at 850°–870° C. The pure aluminum is then added to the hot crucible, and as the pure aluminum melts, the temperature is reduced to 690° C. and the A520 is added to the molten aluminum.

After the modified 2024 is molten, the melt is blown with argon for approximately 15 minutes.

The vacuum lid is then clamped into place and 640 grams of 600 mesh silicon carbide are poured on to the surface of the melt.

The impeller is fastened to the rotary vacuum feedthrough, slowly lowered through the silicon carbide into the molten aluminum, and the feedthrough clamped into place. The crucible is then pumped down to 15–20 torr or lower, after which the mixing motor is turned on and set to rotate at approximately 750 rpm.

After 5 minutes of mixing the chamber is brought to atmospheric pressure with argon, the vacuum feedthrough lifted slightly, and any excess silicon carbide powder coating the walls is scraped back into the melt. The chamber is then resealed and evacuated. This cleaning is performed two more times, also at 5 minute intervals. The melt is stirred for another 15 minutes, the chamber vented, and the preweighed copper, in the form of shot, added. The chamber is reevacuated and mixed for an additional 5 minutes.

The motor is then stopped, the chamber vented with argon, the impeller removed, and the vacuum lid unclamped. The pressure casting lid with the heated mold and fill-tube is clamped into place, and the fill tube immersed in the molten aluminum composite to nearly the bottom of the crucible.

The inside of the chamber is then slowly pressurized to 1.5 psi through an external valve, this low pressure forcing the composite up the filled tube into the mold.

When the aluminum seeps out of the small vent hole and seals it, the pressure is raised to about 9 psi until the metal within the mold is completely solidified.

After the metal cools it can be knocked out of the mold.

While our invention is particularly advantageous as regards production of wrought aluminum alloy composites, it can also be utilized in the production of composites which utilize casting aluminum alloy compositions.

Besides silicon carbide in particle, whisker, or similar form, other reinforcements which can be used are, for example, boron nitride, silicon nitride, aluminum oxide, and the like, as well as mixtures thereof.

The particular impeller used in our invention is highly effective when used as the sole means for achieving the required shearing and wiping action. It may also be used, alternatingly, with a vortex-producing impeller, whereby the latter pulls the particulate into the body of the melt, following which that impeller is removed, and replaced with the first described which, then, wets the particles as a result of the shearing and wiping action it provides.

The mesh of the reinforcement materials may be varied, with concomitant modification of other parameters hereinbefore discussed, in process steps and conditions, and depending also on the desiderata with respect to the physical and mechanical characteristics of the finished composited.

It will be appreciated that various changes, rearrangements and modification may be made in the preferred embodiments without departing from the spirit and scope of the invention, and to the extent that such variant forms of our invention are possible, said forms are considered to be within the scope and essence of our invention.

What is claimed is:

1. A method for producing a composite of an aluminum alloy reinforced with particles of refractory ceramic material, which comprises:

melting an aluminum alloy in a crucible, under cover of an inert gas;

introducing an inert gas into the body of the melt to remove hydrogen from the melt, and bring oxide particles to the surface;

adding the particles of the refractory ceramic material to the melt while maintaining the surface of the melt under cover of the inert gas;

mixing the particles of the refractory ceramic material and melt, under vacuum, by means of an impeller which effects sufficient shearing and wiping to wet the refractory material with the melt and form a substantially homogeneous mixture of refractory material with the aluminum alloy; and casting the resulting mixture.

2. A method for producing a composite of aluminum alloy reinforced with particles of a refractory ceramic material, which comprises:

melting an aluminum alloy;

adding refractory ceramic particles to said melt;

agitating the mixture of particles and melt under vacum to effect sufficient shearing and wiping to substantially wet the particles with the molten metal; and casting the resulting mixture.

3. A method for producing a composite of aluminum alloy reinforced with particles of refractory ceramic material which comprises:

melting aluminum or aluminum alloy in a crucible under cover of an inert gas;

adding particles of the refractory ceramic material to the melt while minimizing the introduction of gas into the melt;

agitating the mixture of refractory material and melt under vacuum to effect sufficient shearing and wiping to substantially wet the refractory material with the melt and form a substantially homogeneous mixture of refractory material and alloy;

casting the resulting mixture to form a billet.

4. A method according to claims 1, 2 or 3 wherein the refractory ceramic material is selected from the group consisting of metallic oxides, carbides, and nitrides.

5. A method according to claims 1, 2 or 3 wherein the refractory ceramic material is silicon carbide.

6. A method according to claims 1, 2 or 3, wherein the aluminum alloy is selected from the group consisting of 6061, 7075, 7079, and 2024 alloys.

7. A composite prepared by the process of claim 2, wherein said step of agitating is accomplished by an impeller.

8. A composite prepared by the method of claim 1.

9. A composite prepared by the method of claim 2.

10. A composite prepared by the method of claim 3.

11. The method of claim 1, wherein the refractory ceramic material is aluminum oxide.

12. The method of claim 2, wherein the refractory ceramic material is aluminum oxide.

13. The method of claim 3, wherein the refractory ceramic material is aluminum oxide.

* * * * *